US011493300B2

(12) United States Patent
Sibottier et al.

(10) Patent No.: US 11,493,300 B2
(45) Date of Patent: Nov. 8, 2022

(54) AIMING DEVICE FOR A WEAPON SYSTEM COMPRISING A WEAPON SECURED TO A CHASSIS AND A METHOD IMPLEMENTING SUCH A DEVICE

(71) Applicant: NEXTER SYSTEMS, Roanne (FR)

(72) Inventors: Olivier Sibottier, Bourges (FR); Julien Busse, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 0 days.

(21) Appl. No.: 17/356,405

(22) Filed: Jun. 23, 2021

(65) Prior Publication Data

US 2022/0074698 A1 Mar. 10, 2022

(30) Foreign Application Priority Data

Jun. 26, 2020 (FR) ..... 2006650

(51) Int. Cl.
*F41A 27/30* (2006.01)
*F41A 27/22* (2006.01)
*F41A 27/24* (2006.01)

(52) U.S. Cl.
CPC ..... *F41A 27/30* (2013.01); *F41A 27/22* (2013.01); *F41A 27/24* (2013.01)

(58) Field of Classification Search
CPC ..... F41A 27/22; F41A 27/24; F41A 27/30
See application file for complete search history.

(56) References Cited

U.S. PATENT DOCUMENTS 4,166,406 A * 9/1979 Maughmer ..... F41G 5/24 89/41.09
4,302,666 A * 11/1981 Hawkins ..... G05B 19/39 235/404

(Continued)

FOREIGN PATENT DOCUMENTS

KR 10-2011-0100959 A 9/2011

OTHER PUBLICATIONS

Foss, Christopher F, "Roll Out: Mapping the Appetite for Wheeled Artillery", Jane's International Defence Review, Jane's Information Group, Coulsdon, Surrey, GB, vol. 47, No. 7, Jul. 1, 2014, pp. 36-39, and 41.

(Continued)

*Primary Examiner* — Bret Hayes
(74) *Attorney, Agent, or Firm* — Oliff PLC

(57) ABSTRACT

An aiming method for a weapon system including a weapon secured to a chassis, as well as an aiming device implementing such a method. The weapon system includes a computer having in an internal memory a nominal firing profile defined by the extreme elevation and relative bearing aiming instructions that are possible for the weapon, in the reference frame associated with the chassis, when the latter is in a firing position on a horizontal ground. The boundaries of the nominal firing profile are converted so as to determine a transformed firing profile which is delimited by the extreme directions of fire that are possible in the reference frame of the chassis when the latter is in the firing position on the field, and finally the operating firing profile is determined for the aiming, which is defined as the geometric intersection of the nominal firing profile and the transformed firing profile.

9 Claims, 3 Drawing Sheets

(56) References Cited

U.S. PATENT DOCUMENTS

| | | | | |
|---|---|---|---|---|
| 4,632,012 | A * | 12/1986 | Feige | F41G 5/14 235/407 |
| 8,833,232 | B1 * | 9/2014 | Fox | F41G 3/165 89/41.14 |
| 9,074,847 | B1 * | 7/2015 | Sullivan | F41G 5/16 |
| 9,886,040 | B1 | 2/2018 | Kelly | |
| 2008/0048033 | A1 * | 2/2008 | Quinn | F41G 3/16 89/41.17 |
| 2012/0024143 | A1 * | 2/2012 | Shacklee | F41G 5/14 89/41.02 |
| 2012/0186440 | A1 * | 7/2012 | McKee | F41A 27/20 89/41.02 |
| 2015/0174979 | A1 | 6/2015 | Raczek et al. | |

OTHER PUBLICATIONS

Feb. 22, 2021 Search Report issued in French Patent Application No. 2006650.
Feb. 22, 2021 Written Opinion issued in French Patent Application No. 2006650.

* cited by examiner

AIMING DEVICE FOR A WEAPON SYSTEM COMPRISING A WEAPON SECURED TO A CHASSIS AND A METHOD IMPLEMENTING SUCH A DEVICE

The technical field of the invention is that of automatic aiming methods for weapon systems and particularly for artillery pieces.

Mobile artillery pieces have an aiming range that is limited by a physical or software profile. This profile is set by mechanical limits for the aiming but also by software limits that ensure the stability of the artillery piece during the impulse caused by a maximum load fire.

The nominal aiming profile is suitable for aiming and firing under nominal conditions, namely on a substantially level ground. When the weapon system (the artillery piece) is emplaced on a sloping ground, for example on a transverse slope, firing with aiming angles that are at the boundaries of the nominal profile can result in the destabilization of the weapon system because of the modification of the weapon system's basis of support due to the transverse slope, or can result in the physical impossibility of aiming at a desired coordinate due to mechanical interference.

The allowed aiming profile under sloping or transverse slope conditions is therefore smaller than the nominal aiming profile. These limitations require that the weapon system be folded up and moved to another, more suitable, geographical position, further lengthening the time required to bring the weapon system into action.

Patent application US 2015/0,174,979 A1 describes an example of such a mobile artillery piece that has the above problem.

Patent application KR 2011 0100959 A addresses the problem of sloping or transverse slope conditions but proposes, as a solution, a device that compensates for these sloping or transverse slope conditions, in an essentially mechanical manner.

The invention provides an aiming method for predicting the compatibility of an operating position with the aiming profile of a weapon system and particularly an artillery piece.

Thus, the invention relates to an aiming method for a weapon system comprising a weapon secured to a chassis, the weapon system comprising an aiming device for aiming the weapon, the aiming device comprising a navigation means for determining, relative to a fixed reference frame, the position and orientation of a reference frame associated with the chassis, as well as motor means enabling the weapon to be aimed in elevation and relative bearing and angular measurement means for determining the aiming angles of the weapon relative to the chassis, the aiming device comprising a computer connected to the angular measurement means and to the navigation means, the computer having in an internal memory a nominal firing profile defined by extreme elevation and relative bearing aiming instructions that are possible for the weapon, therefore extreme possible directions of fire that correspond to a maximum load fire, in the reference frame associated with the chassis, when the chassis is in a firing position on a horizontal ground, the method being characterized in that, when the chassis is in a firing position on a field:

- a transfer matrix is determined, which makes it possible to transition instructions expressed in the fixed reference frame to instructions expressed in the reference frame associated with the chassis;
- boundaries of the nominal firing profile are converted so as to determine a transformed firing profile which is delimited by the extreme directions of fire that are possible in the reference frame associated with the chassis when the chassis is in the firing position on the field;
- an operating firing profile is determined for the aiming, which is defined as the geometric intersection of the nominal firing profile and the transformed firing profile.

According to one embodiment, the conversion of the nominal firing profile into a transformed firing profile may be carried out by applying the transfer matrix thereto.

In another embodiment, the conversion of the nominal firing profile into the transformed firing profile may be carried out by using abacuses associated with different ranges of pitch and roll angles associated with the chassis relative to the fixed reference frame.

According to another feature of the invention, after receiving an aiming instruction expressed in the fixed reference frame, the aiming instruction can be converted into the reference frame associated with the chassis and it is checked that the thus-converted instruction is within the operating firing profile, wherein firing is authorized if this condition is verified and firing is prohibited if this condition is not verified.

Advantageously, an outline of the operating firing profile and optionally the aiming instruction could be displayed on an interface.

The invention also relates to an aiming device for a weapon system, the weapon system comprising a weapon secured to a chassis, the aiming device being configured to implement the aiming method according to any one of the preceding features, the aiming device comprising a navigation means for determining, relative to a fixed reference frame, the position and orientation of a reference frame associated with the chassis, as well as motor means enabling the weapon to be aimed in elevation and relative bearing and angular measurement means for determining the aiming angles of the weapon relative to the chassis, the aiming device comprising a computer connected to the angular measurement means and to the navigation means, the computer having in an internal memory a nominal firing profile defined by extreme elevation and relative bearing aiming instructions that are possible for the weapon system, therefore extreme possible directions of fire that correspond to a maximum load fire, in the reference frame associated with the chassis, when the chassis is in a firing position on a horizontal ground, the device being characterized in that the computer incorporates algorithms for converting, when the chassis is in the firing position on the field, boundaries of the nominal firing profile so as to determine a transformed firing profile which is delimited by the extreme directions of fire that are possible in the reference frame associated with the chassis when the chassis is in the firing position on the field and also to determine an operating firing profile for aiming, which is defined as the geometric intersection of the nominal firing profile and the transformed firing profile.

According to one embodiment, the conversion algorithms could use computing of a transfer matrix making it possible to transition from instructions expressed in the fixed reference frame to instructions expressed in the reference frame associated with the chassis.

In another embodiment, the conversion algorithms may use abacuses giving different transformed firing profiles associated with different ranges of pitch and roll angles of the chassis relative to the fixed reference frame.

Advantageously, the aiming device may incorporate an interface for displaying an outline of the operating firing profile and optionally an aiming instruction.

The invention will be better understood upon reading the following description, which is made in light of the attached drawings, in which.

Figure 1:
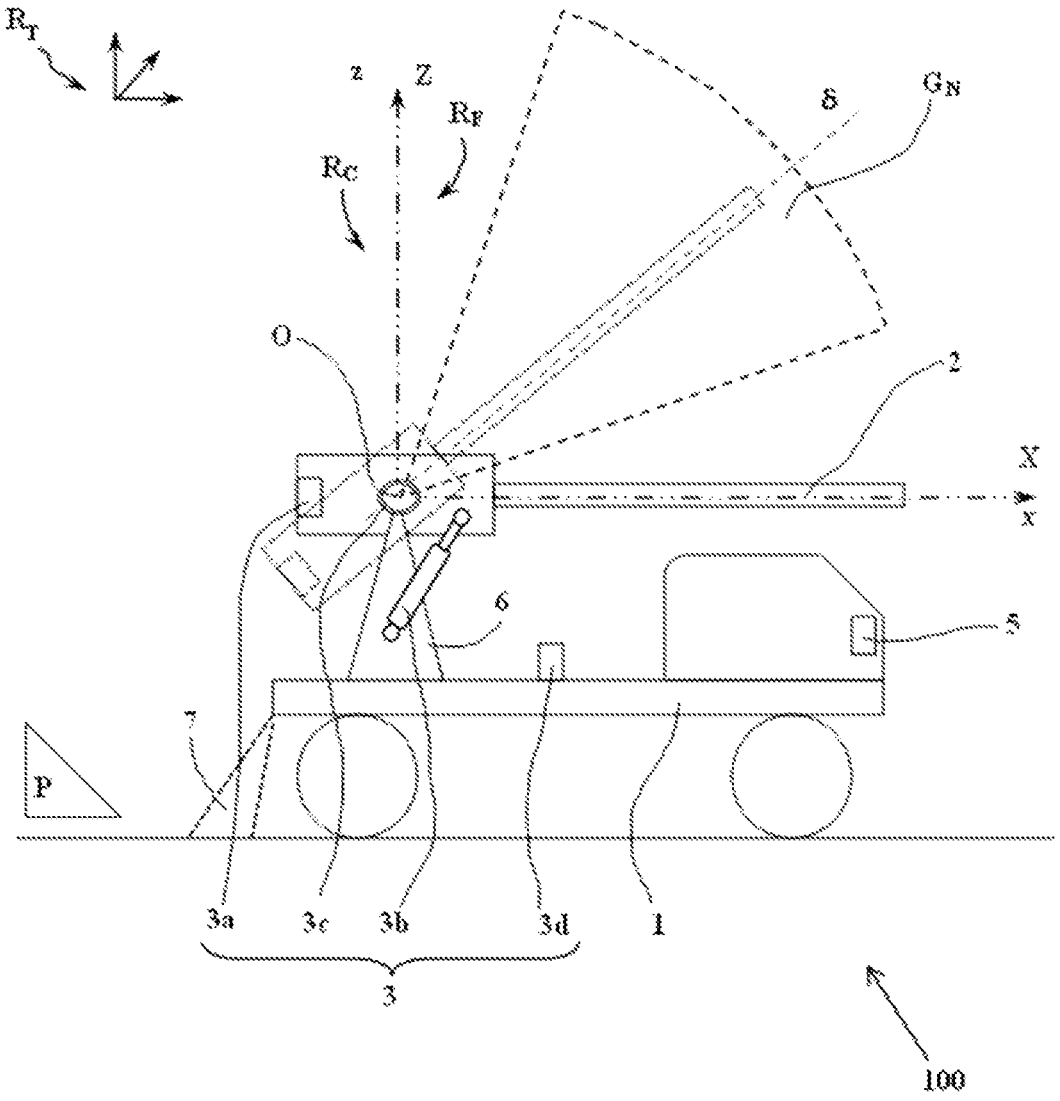
FIG. 1 shows a schematic view of a weapon system which is an artillery piece in a mobility configuration on a horizontal ground.

According to FIG. 1, a weapon system 100 which is here an artillery piece 100 comprises a rolling chassis 1 on which is attached a weapon 2 that can be aimed in elevation and in relative bearing.

The weapon system thus comprises an aiming device 3 comprising a navigation means 3*a*, such as an inertial unit 3*a*, which is secured to the weapon 2. This inertial unit can measure the position and the orientations of the weapon 2 in a terrestrial reference frame $R_T$. The aiming device 3 also includes motor means here comprising a jack 3*b* capable of aiming the weapon 2 in elevation and a motorization (not shown) allowing the aiming in relative bearing with respect to the chassis 1. The aiming in relative bearing may be ensured by a motorization pivoting the weapon's carriage 6 around an axis perpendicular to the chassis 1.

The aiming device 3 is also equipped with angular measurement means 3*c* between the chassis 1 and the weapon 2, such as gyrometers or other sensors 3*c*, to measure the elevation and relative bearing angles of the weapon 2 relative to the chassis 1.

Finally, the aiming device 3 has a central computer 3*d* which is connected to the navigation means 3*a* and to the angular measurement means 3*c*.

The angular information collected in real time by the central computer 3*d* is used and its result is displayed on a user interface 5 (for example, a screen).

The weapon system 100 is put in a mobility configuration, namely not deployed and parked in position on the field.

The point O positioned at the center of the trunnions of the weapon 2 (trunnions not shown), and which corresponds to the geographical position of the weapon system 100, will now be considered.

A fixed reference frame $R_F$ is defined, which is centered on the point O and whose axes Ox, Oy, Oz are parallel to the axes of the terrestrial reference frame $R_T$. A chassis reference frame $R_C$ is also defined, which also has the point O as the center, whose axis OX is parallel to the longitudinal axis of the chassis, axis OZ is perpendicular to the chassis and axis OY (not visible on the figure) is perpendicular to axes OX and OZ.

The chassis 1 is positioned in the fixed reference frame $R_F$ by pitch, roll and heading (or yaw) angles. The weapon 2 may be aimed in elevation and bearing relative with respect to the chassis 1. The axis Oδ of the tube of the weapon 2 is angularly positioned in the chassis reference frame $R_C$ by elevation and relative bearing angles which are measured by the measurement means 3*c*.

The central computer 3*d* has in its memory a nominal profile $G_N$ which is defined in the chassis reference frame $R_C$ by the extreme elevation and relative bearing aiming instructions that are possible for the weapon system, namely the extreme directions of fire that are possible in the reference frame $R_C$ associated with the chassis, when the latter is in the firing position on a horizontal ground as in FIG. 1.

When the chassis 1 is in the firing position, and in case of a large-caliber weapon system 100, it is generally connected to the ground by rear support means, such as spades 7. Installing the spades causes a rear part of the chassis to be lifted, resulting in an inclination of the axis OX of the chassis reference frame $R_C$ relative to the fixed reference frame $R_F$. This inclination is a fixed datum associated with the weapon system 100 being considered.

For the sake of simplicity, the invention will be explained with reference to FIG. 2, which shows only the aiming angles and the profiles included in a same vertical plane P passing through the axis OX of the chassis reference frame $R_C$. It is understood that the same reasoning can be used for any aiming angles and for the aiming profiles along other directions of the chassis reference frame $R_C$. The method that will now be described remains unchanged.

Figure 2:
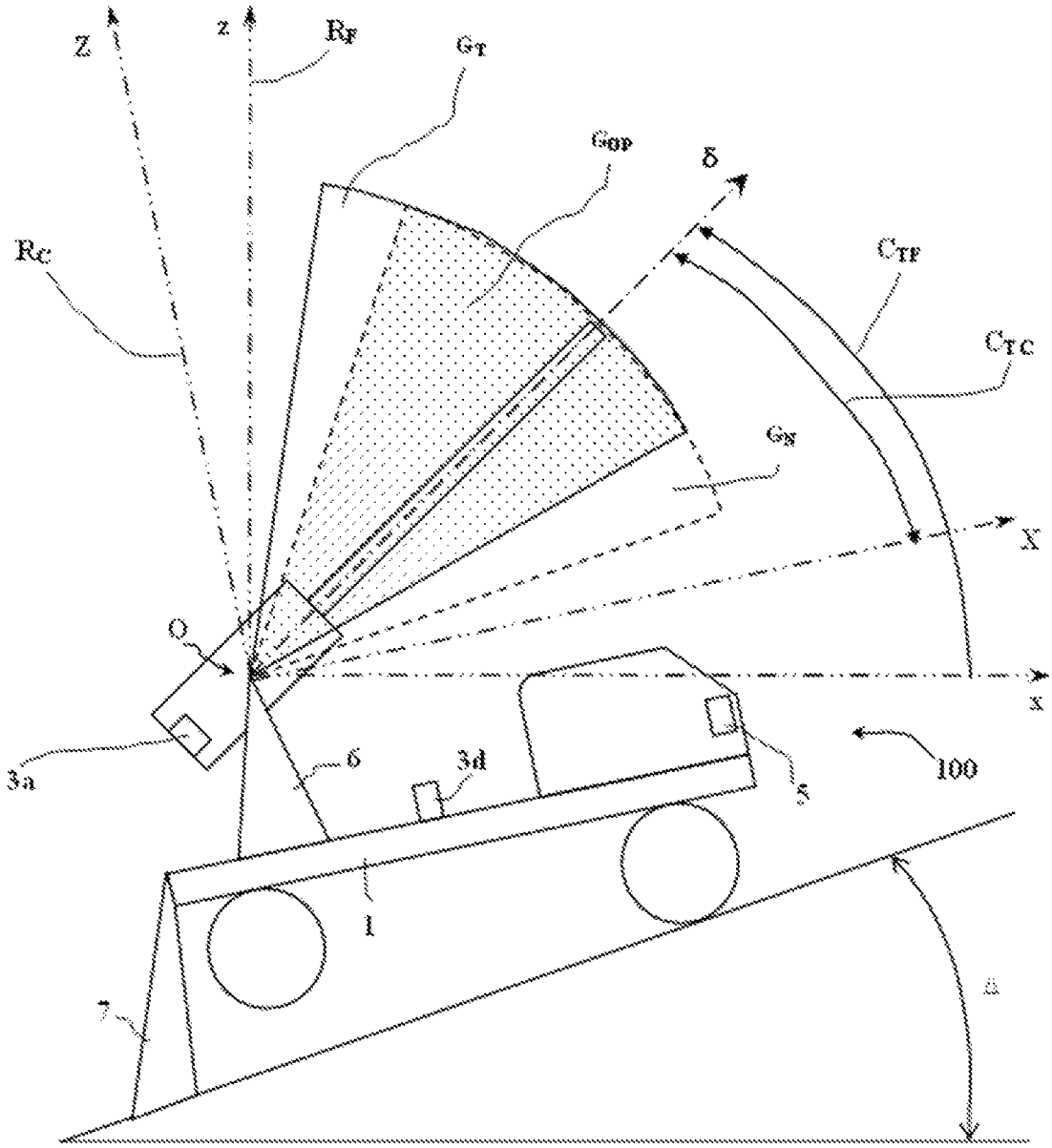
FIG. 2 shows a schematic view of this weapon system emplaced on a sloping ground.

FIG. 2 shows the axes Ox and Oz of the fixed reference frame $R_F$ and the axes OX and OZ of the chassis reference frame $R_C$.

The chassis 1 is positioned on a slope (at an angle Δ relative to the horizontal) and the spades 7 are deployed.

The tube of the weapon 2 is shown, whose direction Oδ aims in elevation with an aiming angle which is noted $C_{TF}$ in the fixed reference frame and $C_{TC}$ in the chassis reference frame.

It is noted here that the difference between these two angles is equal to the angle between the axis OX of the chassis reference frame $R_C$ and the axis Ox of the fixed reference frame $R_F$.

The sector $G_N$ represents the firing profile for the aiming in elevation in the fixed reference frame $R_F$. The transformation of this profile by the matrix making it possible to transition from the fixed reference frame $R_F$ to the chassis reference frame $R_C$ is represented by the sector $G_T$ (transformed profile). And finally, the sector that is noted $G_{OP}$ is the intersection of the sectors $G_N$ and $G_T$.

Figure 3:
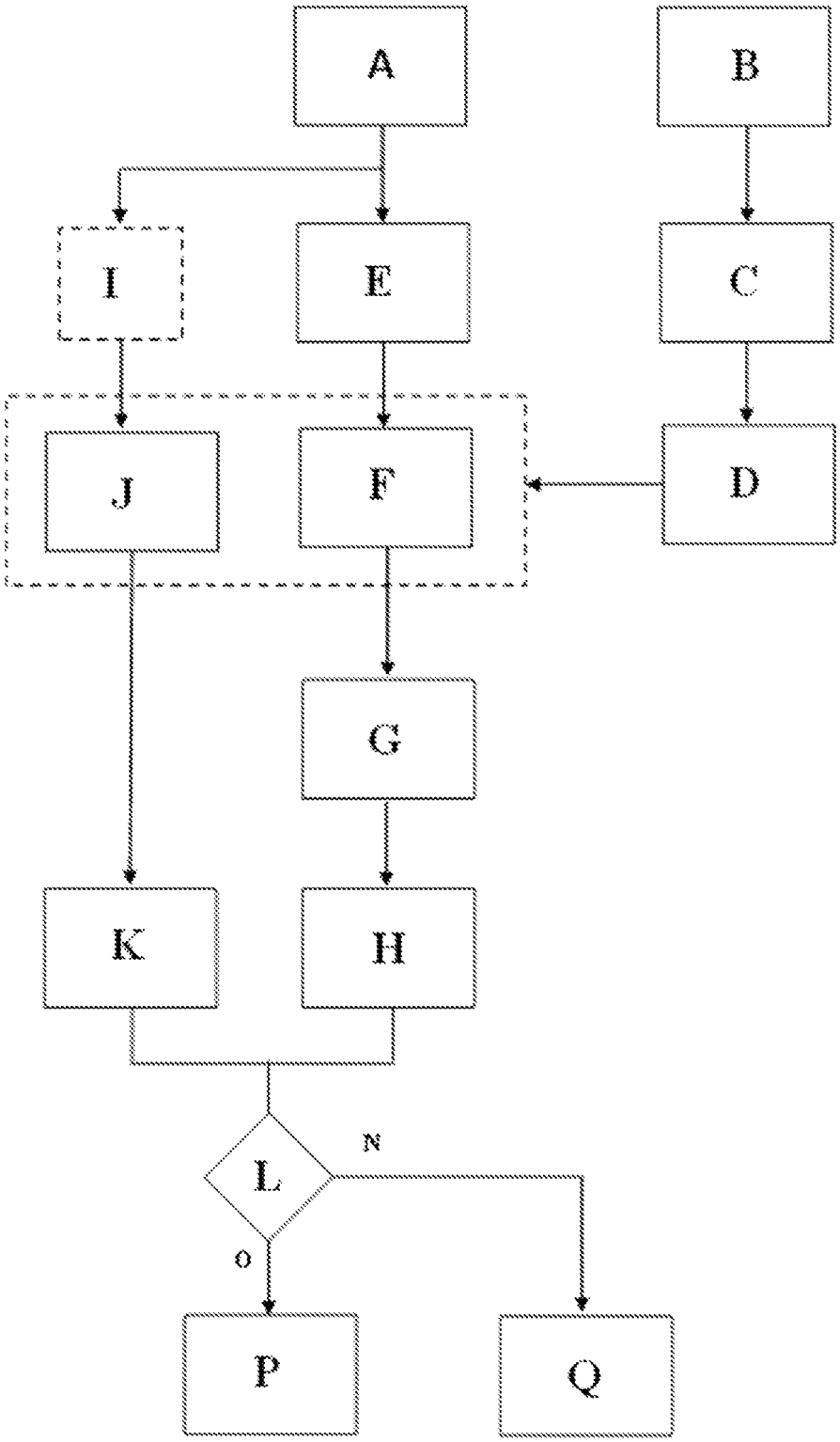
FIG. 3 is a flow chart showing the different steps of the aiming method according to the invention.

The aiming method according to the invention will now be described with reference to the flowchart in FIG. 3.

Block A corresponds to providing firing instructions $C_T$ to the computer 3*d*.

Block B corresponds to providing to the computer 3*d* information related to the angular positions of the chassis reference frame $R_C$ relative to the fixed reference frame $R_F$. This information is provided by the inertial unit 3*a* when the tube of the weapon 2 is actually oriented at zero elevation and relative bearing, namely with the axis Oδ of the tube aligned parallel to the axis OX of the chassis reference frame $R_C$.

Block C corresponds to computing the coefficients of a transfer matrix M allowing to transition from instructions expressed in the fixed reference frame $R_F$ to instructions expressed in the chassis reference frame $R_C$.

The coefficients of this matrix depend on the angular positions of the axes of the chassis reference frame $R_C$ relative to the fixed reference frame $R_F$, which are given by the inertial unit.

Block D corresponds to temporary storing this transfer matrix M which is to be used at different steps later.

Block E uses the firing instructions provided by block A to determine a nominal firing profile $G_N$.

The firing instructions incorporate, as is classical:

- the aiming coordinates, namely the direction, in the fixed reference frame $R_F$, of the axis Oδ of the tube for the desired fire; and
- the firing characteristics: type of shell and propellant charge to be used.

The determination of the nominal firing profile $G_N$ uses the reading of abacuses that are stored in the computer 3*d*. Indeed, the type of charge and of projectile determines the impulse experienced by the weapon and will influence the stability of the weapon system 100.

Step F corresponds to the conversion operation, by the transfer matrix M, of the boundaries of the nominal firing profile $G_N$ so as to determine a transformed firing profile $G_T$ which is delimited by the extreme directions of fire that are possible in the chassis reference frame $R_C$ when it is in the firing position on the field.

This results (step G) in the definition of a transformed firing profile $G_T$.

Step H, conducted by the computer 3*d*, is the determination of an operating firing profile $G_{OP}$ for aiming, which is defined as the geometric intersection of the nominal firing profile $G_N$ and the transformed firing profile $G_T$.

At the same time, the aiming coordinates, which are part of the firing instructions provided in step A and which are provided in the fixed reference frame $R_F$ (firing instructions noted as $C_{TF}$), are converted using the transfer matrix M (step J) to be read in the chassis reference frame $R_C$ (firing instructions noted $C_{Tc}$).

Step K is the temporary storage of this firing instruction $C_{TC}$ (in the chassis reference frame $R_C$).

Step I is an optional step that depends on the operational context and the type of weapon system to which the method according to the invention is applied.

It was previously stated that, for certain weapon systems such as artillery pieces, when the chassis 1 is in the firing position, it is raised and the axis OX of the chassis reference frame $R_C$ is then inclined relative to the fixed reference frame $R_F$. This inclination is a fixed datum associated with the weapon system 100 being considered.

If the previous steps have been conducted on a weapon system 100 that is already anchored to the ground in this way, computing the transfer matrix M provides coefficients for the transition from the fixed reference frame $R_F$ to the chassis reference frame $R_C$ that are directly applicable to the conversion of the firing instruction ($C_{TF} \rightarrow C_{TC}$) and step I is unnecessary.

If, on the other hand, in order to save time, one seeks to determine the possibility of carrying out a firing instruction before anchoring the weapon system to the ground, a second matrix M' will be applied to the received firing instruction $C_{TF}$, the coefficients of which make it possible to transition from instructions expressed in the fixed reference frame $R_F$ to instructions expressed in a reference frame of the chassis anchored to a horizontal ground (therefore with a raised chassis).

This step I can indifferently be positioned either between step A and step J or between step J and step K.

Step L is a test during which it is determined whether or not the firing instruction $C_{TC}$ (in the chassis reference frame $R_C$) is within the operating firing profile $G_{OP}$.

If the result of the test is positive (answer o), step P corresponds to a display at the man-machine interface 5 to inform an operator, on board the weapon system 100, of the possibility of reaching the requested aiming from the position occupied by the weapon system 100.

This display may be indicated by turning on an indicator light, for example, a green light.

If the result of the test is negative (answer N), step Q corresponds to displaying at the man-machine interface 5 the impossibility of reaching the requested aiming from the position occupied by the weapon system 100.

This display may be indicated by turning on an indicator light, for example, a red light.

In either case, the man-machine interface 5 can be used to display, on a screen, the outline of the operating profile $G_{OP}$ and the positioning of the firing instruction $C_{TC}$ relative to this operating profile $G_{OP}$.

It can be noted that, as this computing can be carried out before the implementation of the ground anchoring, the method according to the invention therefore makes it possible to avoid an unnecessary, time-consuming and potentially dangerous emplacement.

According to a variation of the invention and in order to save computing resources, step F consisting in computing the transformed firing profile ($G_T$) may be replaced with a step of reading abacuses stored in the computer 3*d*.

Indeed, a finite number of pre-calculated transformed firing profiles $G_T$ ensuring firing safety for different possible orientations of the chassis relative to the horizontal can indeed be associated with different ranges of values of the pitch and roll angles of the chassis relative to the fixed reference frame $R_F$.

It will be possible to cut out the ranges of possible values for the pitch and roll angles of the chassis and to associate them with a transformed firing profile $G_T$. The discrete nature of this limited choice will be made safe by opting for the most restrictive profiles for a given range of angles, thus by opting for the smallest profiles for a given range.

The other steps of the method will be carried out as described above. In particular, the transfer matrix M will be used to position the firing instruction $C_{TC}$ (in the chassis reference frame $R_C$).

The invention claimed is:

1. An aiming method for a weapon system comprising a weapon secured to a chassis, the weapon system comprising an aiming device for aiming the weapon, the aiming method comprising the following steps:

determining, via navigation means of the aiming device, relative to a fixed reference frame, a position and an orientation of a reference frame associated with the chassis;

operating motor means of the aiming device for aiming the weapon in elevation and relative bearing;

determining, via angular measurement means of the aiming device, aiming angles of the weapon relative to the chassis;

storing, in an internal memory of a computer connected to the angular measurement means and to the navigation means, a nominal firing profile defined by extreme elevation and relative bearing aiming instructions that are possible for the weapon, therefore extreme possible directions of fire that correspond to a maximum load fire, in the reference frame associated with the chassis, when the chassis is in a firing position on a horizontal ground;

wherein, when the chassis is in a firing position on a field, the aiming method further comprises the steps of:

determining a transfer matrix that is used to transition from instructions expressed in the fixed reference frame to instructions expressed in the reference frame associated with the chassis;

converting boundaries of the nominal firing profile so as to determine a transformed firing profile which is delimited by the extreme directions of fire that are possible in the reference frame associated with the chassis when the chassis is in the firing position on the field;

determining an operating firing profile for the aiming, which is defined as a geometric intersection of the nominal firing profile and the transformed firing profile.

2. The aiming method for a weapon system according to claim 1, wherein the conversion of the nominal firing profile into the transformed firing profile is carried out by applying the transfer matrix thereto.

3. The aiming method for a weapon system according to claim 1, wherein the conversion of the nominal firing profile into the transformed firing profile is carried out by using abacuses associated with different ranges of pitch and roll angles of the chassis relative to the fixed reference frame.

4. The aiming method for a weapon system according to claim 1, wherein, after receiving an aiming instruction expressed in the fixed reference frame, the aiming instruction is converted into the reference frame associated with the chassis and a condition is checked that the thus-converted instruction is within the operating firing profile, wherein firing is authorized if the condition is verified and firing is prohibited if the condition is not verified.

5. The aiming method for a weapon system according to claim 4, wherein an outline of the operating firing profile and optionally the aiming instruction are displayed on an interface.

6. The aiming device for the weapon system, the weapon system comprising the weapon secured to the chassis, the aiming device being configured to implement the aiming method according to claim 1, the aiming device comprising:

the navigation means for determining, relative to the fixed reference frame, the position and the orientation of the reference frame associated with the chassis;

the motor means for aiming the weapon in elevation and relative bearing;

the angular measurement means for determining the aiming angles of the weapon relative to the chassis;

the computer connected to the angular measurement means and to the navigation means, the computer having in the internal memory the nominal firing profile defined by the extreme elevation and relative bearing aiming instructions that are possible for the weapon, therefore the extreme possible directions of fire that correspond to the maximum load fire, in the reference frame associated with the chassis, when the chassis is in the firing position on the horizontal ground, wherein the computer incorporates algorithms for converting, when the chassis is in the firing position on the field, the boundaries of the nominal firing profile so as to determine the transformed firing profile which is delimited by the extreme directions of fire that are possible in the reference frame associated with the chassis when the chassis is in the firing position on the field and also to determine the operating firing profile for aiming, which is defined as the geometric intersection of the nominal firing profile and the transformed firing profile.

7. The aiming device according to claim 6, configured to implement the method wherein the conversion algorithms use computing of the transfer matrix to transition from instructions expressed in the fixed reference frame to instructions expressed in the reference frame associated with the chassis.

8. The aiming device according to claim 6 configured to implement the method wherein the conversion algorithms use abacuses giving different transformed firing profiles associated with different ranges of pitch and roll angles of the chassis relative to the fixed reference frame.

9. The aiming device according to claim 6, wherein the aiming device incorporates an interface for displaying an outline of the operating firing profile and optionally an aiming instruction.

* * * * *